US009038738B2

(12) United States Patent
Levie et al.

(10) Patent No.: US 9,038,738 B2
(45) Date of Patent: May 26, 2015

(54) COMPOSITE CENTRALIZER WITH EXPANDABLE ELEMENTS

(75) Inventors: William Iain Levie, The Woodlands, TX (US); David Levie, Kastanienbaum (CH)

(73) Assignee: Halliburton Energy Services, Inc., Houston, TX (US)

( * ) Notice: Subject to any disclaimer, the term of this patent is extended or adjusted under 35 U.S.C. 154(b) by 399 days.

(21) Appl. No.: 13/416,746

(22) Filed: Mar. 9, 2012

(65) Prior Publication Data

US 2013/0233568 A1 Sep. 12, 2013

(51) Int. Cl.
*E21B 17/10* (2006.01)

(52) U.S. Cl.
CPC ..... *E21B 17/1028* (2013.01); *E21B 17/1078* (2013.01)

(58) Field of Classification Search
CPC ..... E21B 17/1028; E21B 17/1014; E21B 17/1078
USPC ..... 166/381, 382, 241.6, 213; 175/325.5
See application file for complete search history.

(56) References Cited

U.S. PATENT DOCUMENTS

| | | | | |
|---|---|---|---|---|
| 2,170,527 | A * | 8/1939 | Culbertson | 166/241.6 |
| 2,665,762 | A * | 1/1954 | Althouse, Jr. | 166/241.7 |
| 2,731,816 | A * | 1/1956 | Hall | 166/285 |
| 2,824,613 | A * | 2/1958 | Baker et al. | 166/241.7 |
| 3,270,697 | A | 9/1966 | Solum | |
| 3,643,739 | A * | 2/1972 | Hall, Sr. | 166/241.6 |
| 3,749,168 | A * | 7/1973 | Hall, Sr. | 166/241.7 |
| 5,575,333 | A * | 11/1996 | Lirette et al. | 166/241.1 |
| 6,285,014 | B1 * | 9/2001 | Beck et al. | 219/644 |
| 6,457,519 | B1 * | 10/2002 | Buytaert | 166/241.6 |
| 6,484,803 | B1 * | 11/2002 | Gremillion | 166/241.6 |
| 6,679,325 | B2 | 1/2004 | Buytaert | |
| 7,156,171 | B2 * | 1/2007 | Gremillion | 166/241.6 |
| 7,182,131 | B2 * | 2/2007 | Gremillion | 166/241.6 |
| 7,708,064 | B2 * | 5/2010 | Sehsah | 166/241.6 |
| 7,845,061 | B2 * | 12/2010 | Buytaert et al. | 29/557 |
| 7,878,241 | B2 * | 2/2011 | Buytaert et al. | 166/241.6 |
| 8,245,777 | B2 * | 8/2012 | Garner | 166/213 |
| 8,505,624 | B2 * | 8/2013 | Levie | 166/241.6 |
| 2003/0150611 | A1 * | 8/2003 | Buytaert | 166/241.6 |
| 2005/0224123 | A1 | 10/2005 | Baynham et al. | |
| 2007/0131414 | A1 | 6/2007 | Calderoni et al. | |

(Continued)

OTHER PUBLICATIONS

"Specifications for bow-spring casing centralizers," API Specification 10D, Mar. 2002, 6th edition, 24 pages, American Petroleum Institute, Washington, D.C.

(Continued)

*Primary Examiner* — Jennifer H Gay
(74) *Attorney, Agent, or Firm* — John W. Wustenberg; Baker Botts L.L.P.

(57) ABSTRACT

A centralizer comprises a first body portion, a second body portion, a plurality of bow springs connecting the first body portion to the second body portion, and one or more expandable elements coupled to the first body portion and the second body portion. A method of centralizing a wellbore tubular comprises compressing a bow spring radially inward from a starting position to a compressed position, wherein the bow spring is coupled to a first body portion and a second body portion, applying a tensile force between the first body portion and the second body portion while the bow spring is in the compressed position, and restoring the bow spring from the compressed position to the starting position.

18 Claims, 6 Drawing Sheets

(56) References Cited

U.S. PATENT DOCUMENTS

| | | | | |
|---|---|---|---|---|
| 2009/0166027 | A1* | 7/2009 | Sehsah | 166/241.6 |
| 2010/0078173 | A1* | 4/2010 | Buytaert et al. | 166/302 |
| 2011/0030973 | A1* | 2/2011 | Jenner | 166/382 |
| 2011/0146971 | A1* | 6/2011 | Buytaert et al. | 166/241.6 |
| 2011/0186290 | A1* | 8/2011 | Roddy et al. | 166/253.1 |
| 2012/0145410 | A1* | 6/2012 | Levie | 166/382 |
| 2012/0186808 | A1* | 7/2012 | Lively et al. | 166/241.6 |
| 2012/0186828 | A1* | 7/2012 | Lively et al. | 166/381 |
| 2013/0087334 | A1* | 4/2013 | Buytaert et al. | 166/288 |
| 2013/0233568 | A1* | 9/2013 | Levie et al. | 166/381 |
| 2013/0319689 | A1* | 12/2013 | Levie et al. | 166/382 |
| 2013/0319690 | A1* | 12/2013 | Levie et al. | 166/382 |

OTHER PUBLICATIONS

Foreign communication from a related counterpart application—International Search Report and Written Opinion, PCT/US2013/023230, Mar. 14, 2014, 9 pages.

* cited by examiner

COMPOSITE CENTRALIZER WITH EXPANDABLE ELEMENTS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations that contain hydrocarbons to allow recovery of the hydrocarbons. Some wellbore servicing methods employ wellbore tubulars that are lowered into the wellbore for various purposes throughout the life of the wellbore. Since wellbores are not generally perfectly vertical, centralizers are used to maintain the wellbore tubulars aligned within the wellbore. Alignment may help prevent any friction between the wellbore tubular and the side of the wellbore wall or casing, potentially reducing any damage that may occur. Common spring centralizers use stop collars located at either end of the centralizer to maintain the centralizer position relative to the wellbore tubular as the tubular is conveyed into and out of the wellbore. The spring centralizer may be free to move within the limits of the stop collars. Spring centralizers with stop collars are not suitable for all applications within a wellbore and improvements in centralizers may still be made.

SUMMARY

In an embodiment, a centralizer comprises a first body portion, a second body portion, a plurality of bow springs connecting the first body portion to the second body portion, and one or more expandable elements coupled to the first body portion and the second body portion. The one or more expandable elements may extend substantially straight between the first body portion and the second body portion. The one or more expandable elements may comprise a composite material, and wherein the composite material comprises a fiber and a matrix material. The fiber may comprise a cellulosic fiber, a carbon fiber, an aramid fiber, or any combination thereof. The matrix material may comprise a resin comprising at least one component selected from the group consisting of: an orthophthalic polyester, an isophthalic polyester, a phthalic/maelic type polyester, a vinyl ester, a thermosetting epoxy, a phenolic, a cyanate, a bismaleimide, a nadic end-capped polyimide, a polysulfone, a polyamide, a polycarbonate, a polyphenylene oxide, a polysulfide, a polyether ether ketone, a polyether sulfone, a polyamide-imide, a polyetherimide, a polyimide, a polyarylate, a liquid crystalline polyester, a polyurethane, a polyurea, and any combinations thereof. The matrix material may also comprise one or more elastomeric components. The one or more expandable elements may be disposed between adjacent bow springs of the plurality of bow springs. The one or more expandable elements may be configured to provide a tensile force between the first body portion and the second body portion. The plurality of bow springs may be configured to provide a first portion of a restoring force for the centralizer and the one or more expandable elements may be configured to provide a second portion of the restoring force for the centralizer. The ratio of the first portion of the restoring force to the second portion of the restoring force may be between about 1:10 and about 10:1. The second portion of the restoring force may be greater than about 10% of the restoring force for the centralizer.

The centralizer may also include a wellbore tubular disposed longitudinally within the first body portion, the second body portion, the plurality of bow springs, and the one or more expandable elements, and a stop collar coupled to the wellbore tubular and configured to limit the longitudinal movement of the centralizer with respect to the wellbore tubular. The centralizer may also include a collar link coupled to the first body portion and the stop collar. The collar link may comprise an extension of at least a portion of the one or more expandable elements. The one or more expandable elements may comprise a composite material, wherein the composite material comprises a fiber and a matrix material, and wherein the collar link comprises the fiber of the one or more expandable elements that extends through the first body portion. The collar link may comprise a shear mechanism. The centralizer may also include a third body portion, where the third body portion may be coupled to a first portion of the plurality of bow springs and a second portion of the plurality of bow springs.

In an embodiment, a method of centralizing a wellbore tubular comprises engaging a centralizer disposed on a wellbore tubular with a restriction in a wellbore, radially compressing the bow springs, wherein radially compressing the bow springs lengthens the one or more expandable elements, disengaging the centralizer from the restriction, and radially expanding the bow springs, wherein at least a portion of a force to radially expand the bow springs is provided by the expandable elements. The centralizer comprises a first body portion, a second body portion, a plurality of bow springs connecting the first body portion to the second body portion, and one or more expandable elements coupled to the first body portion and the second body portion. The restriction may comprise a close tolerance restriction.

In an embodiment, a method of centralizing a wellbore tubular comprises compressing a bow spring radially inward from a starting position to a compressed position, wherein the bow spring is coupled to a first body portion and a second body portion, applying a tensile force between the first body portion and the second body portion while the bow spring is in the compressed position, and restoring the bow spring from the compressed position to the starting position.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
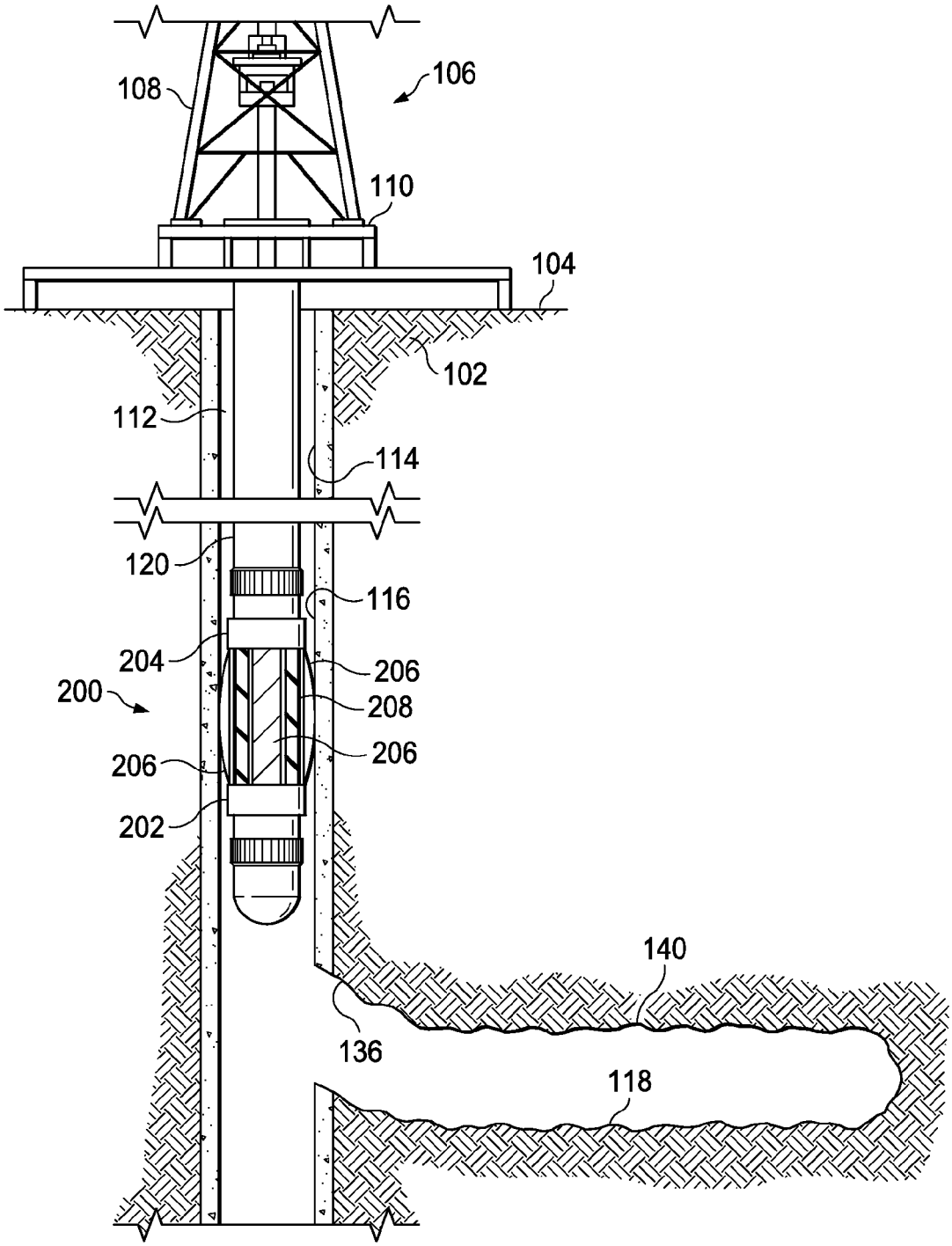
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclosed herein is a centralizer for use with a wellbore tubular. The centralizer may comprise one or more expandable elements coupled to a first and second body portion of the centralizer. The expandable elements may provide an additional tensile force between the body portions when the bows of the centralizer are compressed and the body portions are displaced apart from each other. The additional tensile force may account for a portion of the restoring force of the centralizer, thereby allowing the bows to be thinner, and the overall profile of the centralizer to be reduced. The centralizer may then be used in close tolerance wellbores. These and other advantages will be apparent in light of the description contained herein.

Referring to FIG. 1, an example of a wellbore operating environment is shown. As depicted, the operating environment comprises a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbore for drilling and completing one or more production zones. Further the wellbore may be used for both producing wells and injection wells. In an embodiment, the wellbore may be used for purposes other than or in addition to hydrocarbon production, such as uses related to geothermal energy.

A wellbore tubular string 120 comprising a centralizer 200 may be lowered into the subterranean formation 102 for a variety of workover or treatment procedures throughout the life of the wellbore. The embodiment shown in FIG. 1 illustrates the wellbore tubular 120 in the form of a casing string being lowered into the subterranean formation. It should be understood that the wellbore tubular 120 comprising a centralizer 200 is equally applicable to any type of wellbore tubular being inserted into a wellbore, including as non-limiting examples drill pipe, production tubing, rod strings, and coiled tubing. The centralizer 200 may also be used to centralize various subs and workover tools. In the embodiment shown in FIG. 1, the wellbore tubular 120 comprising centralizer 200 is conveyed into the subterranean formation 102 in a conventional manner and may subsequently be secured within the wellbore 114 by filling an annulus 112 between the wellbore tubular 120 and the wellbore 114 with cement.

The drilling rig 106 comprises a derrick 108 with a rig floor 110 through which the wellbore tubular 120 extends downward from the drilling rig 106 into the wellbore 114. The drilling rig 106 comprises a motor driven winch and other associated equipment for extending the casing string 120 into the wellbore 114 to position the wellbore tubular 120 at a selected depth. While the operating environment depicted in FIG. 1 refers to a stationary drilling rig 106 for lowering and setting the wellbore tubular 120 comprising the centralizer 200 within a land-based wellbore 114, in alternative embodiments, mobile workover rigs, wellbore servicing units (such as coiled tubing units), and the like may be used to lower the wellbore tubular 120 comprising the centralizer 200 into a wellbore. It should be understood that a wellbore tubular 120 comprising the centralizer 200 may alternatively be used in other operational environments, such as within an offshore wellbore operational environment.

In alternative operating environments, a vertical, deviated, or horizontal wellbore portion may be cased and cemented and/or portions of the wellbore may be uncased. For example, uncased section 140 may comprise a section of the wellbore 114 ready for being cased with wellbore tubular 120. In an embodiment, a centralizer 200 may be used on production tubing in a cased or uncased wellbore. In an embodiment, a portion of the wellbore 114 may comprise an underreamed section. As used herein, underreaming refers to the enlargement of an existing wellbore below an existing section, which may be cased in some embodiments. An underreamed section may have a larger diameter than a section upward from the underreamed section. Thus, a wellbore tubular passing down through the wellbore may pass through a smaller diameter passage followed by a larger diameter passage.

Regardless of the type of operational environment the centralizer 200 is used, it will be appreciated that the centralizer 200 serves to aid in guiding the wellbore tubular 120 through the wellbore 114. As described in greater detail below, the centralizer 200 comprises a first body portion 202, a second body portion 204, a plurality of bow springs 206 connecting the first body portion 202 to the second body portion 204, and one or more expandable elements 208 coupled to the first body portion 202 and the second body portion 204. The centralizer 200 serves to center the wellbore tubular (e.g., casing string 120) within the wellbore 114 as the wellbore tubular 120 is conveyed within the wellbore 114. The centralizer 200 described herein may be used to guide the wellbore tubular 120 through close tolerance restrictions within the wellbore 114. In an embodiment, the centralizer 200 described herein may be used in close tolerance wellbores in which traditional bow spring centralizers using stop collars would not fit, and/or in which traditional bow spring centralizers may not be capable of providing a desired force. The one or more expandable elements 208 may serve to provide a tensile force between the first body portion 202 and the second body portion 204 to alter the amount of force provided by the plurality of bow springs 206.

Several forces are used to characterize centralizers 200. In general, the bow springs 206 provide a force known as a "restoring force" to radially (i.e., laterally) urge the wellbore tubular away from the wall of the wellbore. In an embodiment, the restoring force is directed substantially perpendicular to the wellbore wall. At the same time, the bow springs 206 may be laterally compressible (e.g., in a direction away from the wellbore wall and towards the wellbore tubular wall) so that the wellbore tubular may be moved along the interior of the wellbore notwithstanding the presence in the wellbore of small diameter restrictions and other obstacles to longitudinal movement of the wellbore tubular within the wellbore. Upon encountering a restriction within the wellbore during conveyance, the bow springs may be compressed in order to enter the restriction. The force required to compress the bow springs and insert the centralizer into the interior of the restriction, which may include the initial insertion into the wellbore, is referred to as the "starting force." The contact between the bow springs and the wall of the wellbore may lead to a drag force. The force required to overcome the drag force may be referred to as the "running force," which is the amount of force required to move the wellbore tubular longitudinally along the wellbore with the centralizer affixed to its exterior. Specifications for the amount of restoring force and proper use of centralizers are described in a document entitled, *Specifications for Bow-Spring Centralizers*, API Specification 10D, $6^{th}$ edition, American Petroleum Institute, Washington, D.C. (2002), which is incorporated herein by reference in its entirety. Generally speaking, centralizers are made to center a particular outside diameter (OD) wellbore tubular within a particular nominal diameter wellbore or outer wellbore tubular (e.g., a casing).

Figure 2:
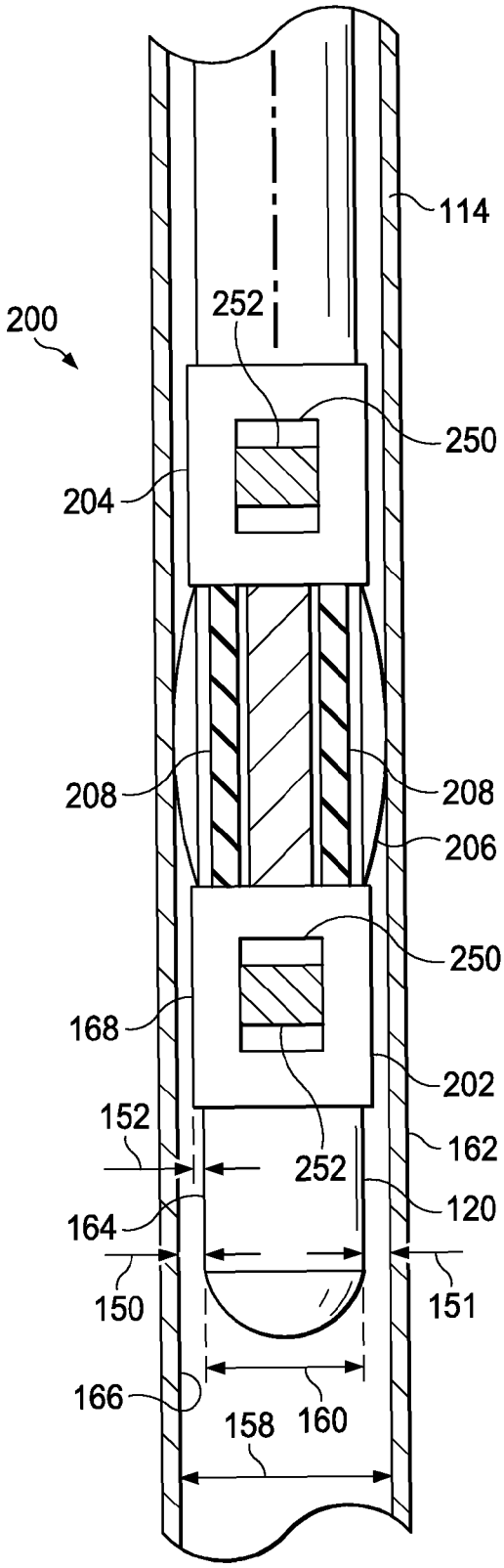
FIG. 2 is a plan view of a centralizer according to an embodiment.

As shown in FIG. 2, the centralizer 200 described herein may be used in a wellbore 114 comprising one or more close tolerance restrictions. A close tolerance restriction generally refers to a restriction in which the inner diameter 158 of the restriction passage is near the outer diameter 160 of a wellbore tubular 120, a tool, or other wellbore apparatus passing through the restriction. The close tolerance restrictions may result from various wellbore designs such as decreasing diameter casing strings, underreamed sections within a wellbore, or collapsed wellbores or casings. For example, passing a smaller diameter casing 120 through a larger diameter casing 162 can create a close tolerance restriction between the outer surface 164 of the smaller diameter casing 120 and the inner surface 166 of the larger diameter casing 162. Examples of casing sizes that may result in close tolerance restrictions within a wellbore 114 are shown in Table 1.

TABLE 1

Close Tolerance Restrictions
Casing Examples

| Smaller Diameter Casing Size (inches) | Passing through | Larger Diameter Casing Size (inches) |
|---|---|---|
| 3.5 | | 4.5 |
| 4.5 | | 5.5 |
| 5 | | 6 |
| 5.5 | | 6 |
| 6.625 | | 7 |
| 7 | | 8.5 |
| 7.625 | | 8.625 |
| 7.75 | | 8.5 |
| 9.625 | | 10.625 |
| 9.875 | | 10.625 |
| 10.75 | | 12 |
| 11.875 | | 13.375 |
| 13.375 | | 14.75 |
| 16 | | 17 |
| 20 | | 22 |

The designation of a restriction in a wellbore 114 as a close tolerance restriction may vary depending on a number of factors including, but not limited to, the tolerances allowed in the wellbore, the tortuosity of the wellbore, the need to use flush or near flush connections, the weight of the casing used in the wellbore, the presence of fluid and/or solids in the wellbore, etc. The tolerances allowed in the wellbore may vary from wellbore to wellbore. The term "annular diameter difference" may be used herein to characterize the tolerances in the wellbore 114 and refers to the total width of the annulus (i.e., the sum of annular width 150 and annular width 151) in the close tolerance restriction. The annular diameter difference is calculated as the difference between the inner diameter 158 of the restriction passage and the outer diameter 160 of the wellbore tubular 120 passing through the restriction. In an embodiment, a close tolerance restriction may have an annular diameter difference of about 0.125 inches, about 0.2 inches, about 0.3 inches, about 0.4 inches, about 0.5 inches, about 0.6 inches, about 0.7 inches, about 0.8 inches, about 0.9 inches, about 1.0 inch, about 1.1 inches, about 1.2 inches, about 1.3 inches, about 1.4 inches, or about 1.5 inches. While an upper limit of about 1.5 inches is used, the upper limit may be greater or less than 1.5 inches depending on the other considerations and factors (including for example, a risk/safety factor) for determining if a close tolerance restriction is present in a wellbore. The tortuosity of the wellbore refers to the deviation of the wellbore from a straight hole. A restriction in a wellbore is more likely to be considered a close tolerance restriction as the tortuosity of the wellbore increases. Further, a wellbore tubular with a flush or near flush connection refers to wellbore tubulars without or with only insubstantial upsets along the outer surface, for example at the connections between joints of the wellbore tubulars. The use of flush or near flush connections may create close tolerance restrictions along greater portions of the wellbore tubulars. Finally, the weight of the wellbore tubular may affect both the flexibility of the wellbore tubular string and the annular diameter difference between the wellbore wall or the inner surface 166 of a larger diameter casing string 162, depending on whether the wellbore 114 has been cased, and the outer surface 164 of a smaller diameter casing string 120. The use of premium grade casing and/or premium grade connections may indicate that the difference between inner and outer pipe diameters is small and indicate that a close tolerance restriction exists within the wellbore 114.

Figure 3A:
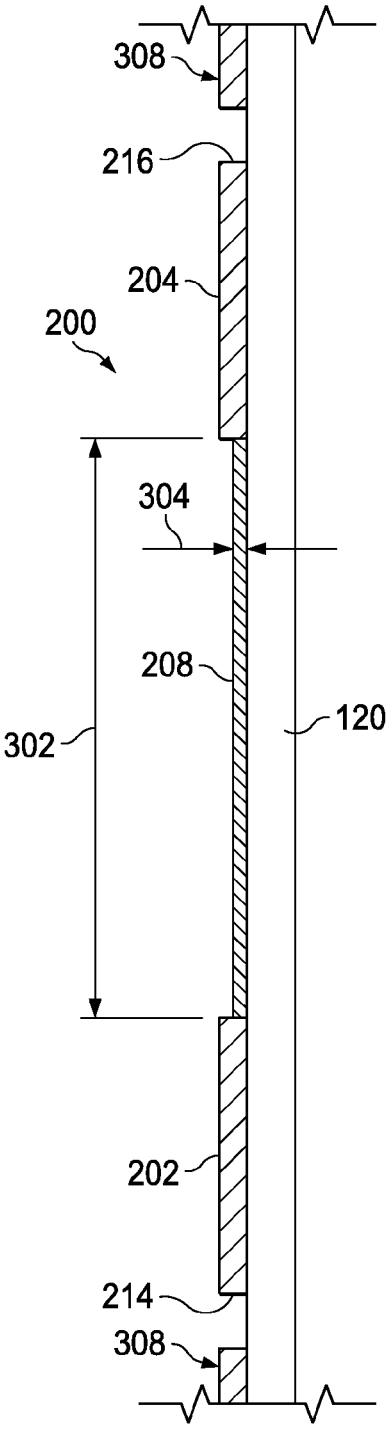
FIG. 3A is a half cross sectional view of a centralizer according to another embodiment.
Figure 3B:
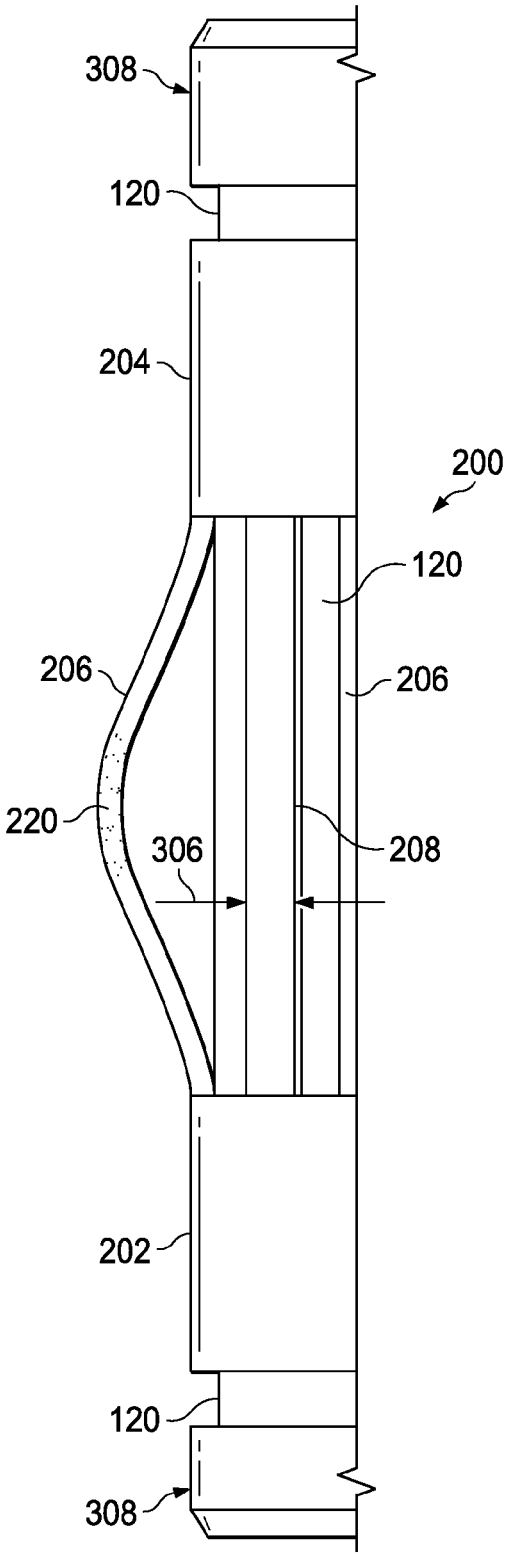
FIG. 3B is a plan view of a centralizer according to another embodiment.

Referring now to FIGS. 3A and 3B, an embodiment of the centralizer 200 is shown in greater detail. As described above, the centralizer 200 comprises a first body portion 202, a second body portion 204, a plurality of bow springs 206 connecting the body portions 202, 204, and one or more expandable elements 208 coupled to the first body portion 202 and the second body portion 204. The body portions 202, 204 and the plurality of bow springs 206 may be formed from steel, a synthetic material, a composite material, or any other similar high strength material. In an embodiment, the body portions 202, 204, and/or the bow springs 206 may be made from a composite material, as described in more detail herein. The body portions 202, 204 may be generally cylindrical in shape and may have an internal diameter selected to be disposed about the exterior of a wellbore tubular to which they are to be coupled. The body portions 202, 204 may have a desired length based on the mechanical requirements of the of the centralizer 200 and taking into account the material of construction and the length necessary to integrate the bow springs 206 and/or the one or more expandable elements 208, as described in more detail below. As used herein, the length of the centralizer 200, the one or more bow springs 206, and/or the one or more expandable elements 208 refers to the dimension of the centralizer 200 in the longitudinal direction of the wellbore tubular 120, and the width of the centralizer 200, the one or more bow springs 206, and/or the one or more expandable elements 208 refers to the dimension in a direction perpendicular to the longitudinal direction of the wellbore tubular 120 along the surface of the wellbore tubular 120. In an embodiment the length of the first body portion 202 and the length of the second body portion 204 may be the same or different.

The leading and/or trailing edges 214, 216 of the first body portion 202 and/or the second body portion 204 may be tapered or angled to aid in movement of the centralizer 200 through the wellbore (e.g., through a restriction and/or upon entering the wellbore). In an embodiment, when stop collars 308 are used to maintain the centralizer 200 in position on the wellbore tubular, the leading and/or trailing edges of the stop collars 308 may be tapered and the leading and/or trailing edges 214, 216 may not be tapered.

Returning to FIG. 2, a plurality of bow springs 206 may be coupled to and connect the body portions 202, 204. The bow springs 206 may be coupled to the first body portion 202 and the second body portion 204 using any means known in the art. For example, the bow springs 206 may be welded, brazed, diffusion bonded, connected using a connector, and/or integrally formed along with the first body portion 202 and the second body portion 204. The bow springs 206 may be formed from a composite material comprising the same components as the first body portion 202 and/or the second body portion 204, or different composite materials from the first body portion 202 and/or the second body portion 204. In an embodiment, one or more of the bow springs may be formed from steel or a similar high strength material. Two or more bow springs 206 may be used to couple the body portions 202, 204. The number of bow springs 206 may be chosen based on the wellbore tubular properties (e.g., weight, size), the wellbore properties (e.g., orientation, tortuosity, etc.), the wellbore service conditions (e.g., temperature, acidity, etc.) and/or the annular diameter difference. The number of bow springs 206 may also be chosen to reduce the starting and/or drag forces while increasing the restoring force available within the wellbore. The bow springs 206 may generally extend longitudinally between the body portions 202, 204. However, additional orientations may be used depending on the desired use of the centralizer. For example, helical and/or angled orientations are also possible. Each of the bow springs 206 may comprise the same materials and orientation. In an embodiment, each bow spring or any combination of the plurality of bow springs may comprise different materials and/or orientations.

The bow springs 206 may generally have an arced profile between the body portions 202, 204, though any suitable shape (e.g., recurved) imparting a standoff from the wellbore tubular and/or a desired restoring force may be used. In an embodiment, the bow springs 206 may have a smooth arc between the body portions 202, 204. In an embodiment, the bow springs 206 may have a multi-step design. In this embodiment, the bow springs may generally have a first arced section between the body portions 202, 204 and a second arced section disposed along the length of the bow spring between the body portions 202, 204. The first and/or second arced sections may be formed in a variety of shapes, (e.g., an arc of increased angle, a sinusoidal curve, etc.). As a result of the multi-step design, the restoring force may increase in steps as the bow spring 206 is displaced in a radial direction towards the center of the centralizer 200. The initial displacement may occur as a result of the flexing of a larger arced section (e.g., a first arced section). Additional inward displacement may cause a second arced section to flex and present a greater restoring force. In an embodiment, a plurality of arced sections could be implemented along a bow spring 206 to create a restoring force profile as desired. In an embodiment, each of the bow springs 206 may comprise the same shape. In another embodiment, each bow spring or any combination of the plurality of bow springs may comprise different shapes.

The restoring force may also be tailored based on additional considerations including, but not limited to, the thickness of a bow spring and/or the width of a bow spring. A bow spring may have a uniform thickness along the length of the bow spring, or the thickness may vary along the length of the bow spring. The thickness of the bow spring 206 may be substantially uniform along the length of the bow spring 206. As used herein, "substantially uniform" refers to a thickness that may vary within the manufacturing tolerances of the component. In an embodiment, the thickness of each arced section may be greater than, less than, or the same as the thickness of any other arced section. In general, the restoring force may increase as the thickness of the bow spring increases. Similarly, the restoring force may increase as the width of the bow spring increases. The thickness, width, and length may be limited based upon the characteristics of the wellbore tubular and the wellbore into which the centralizer is disposed. Further design factors that may affect the restoring force, the starting force, and the running force may include, but are not limited to, the type of fiber or fibers used in forming the bow springs, and/or the type of matrix material or materials used to form the bow springs, each of which are discussed in more detail below. Still further design factors may include the angle of winding of the fibers and the thickness of the fibers.

Referring again to FIG. 3, the bow springs may have a plurality of particulates 220 disposed on the outer surface of the bow springs 206. As used herein, the "outer surface" of the bow springs 206 comprises those portions of the bow springs anticipated to contact a surface of a wellbore and/or tubular into which the centralizer is placed. The particulates may be disposed along the entire length of the bow springs or only those portions anticipated to contact the wellbore wall during conveyance of the centralizer and wellbore tubular within the wellbore. As used herein, disposed on the outer surface generally refers to the particulates being located at the outer surface of the bow springs 206 and may include the particulates being embedded in the outer surface, deposited in and/or on the outer surface, and/or coated on the outer surface. The particulates may generally be resistant to erosion and/or abrasion to prevent wear on the points of contact between the bow spring surfaces and the wellbore walls or inner surfaces of the wellbore. The shape, size, and composition of the particulates may be selected to affect the amount of friction between the bow springs and the wellbore walls during conveyance of the wellbore tubular comprising the centralizer within the wellbore. In general, the particulates may be selected to reduce the running forces required during conveyance of the wellbore tubular within the wellbore. In an embodiment, the particulates may comprise a low surface energy and or coefficient of friction, and/or may comprise substantially spherical particles. The particulates may have a distribution of sizes, or they may all be approximately the same size. In an embodiment, the particulates may be within a distribution of sizes ranging from about 0.001 inches to about 0.2 inches, 0.005 inches to about 0.1 inches, 0.01 inches to about 0.005 inches. In an embodiment, the particulates may be about 0.02 inches to about 0.004 inches. The particulates may comprise any material capable of resisting abrasion and erosion when disposed on a bow spring and contacted with the wellbore wall. In an embodiment, the particulates may be formed from metal and/or ceramic. For example, the particulates may comprise zirconium oxide. In an embodiment, the particulates may be coated with any of the surface coating agents discussed below to aid in bonding between the particulates and one or more materials of construction of the centralizer or any centralizer components.

In an embodiment, the first body portion 202, the second body portion 204, and/or one or more bow springs 206 may be formed from one or more composite materials. A composite material comprises a heterogeneous combination of two or more components that differ in form or composition on a macroscopic scale. While the composite material may exhibit characteristics that neither component possesses alone, the components retain their unique physical and chemical identities within the composite. Composite materials may include a reinforcing agent and a matrix material. In a fiber-based composite, fibers may act as the reinforcing agent. The matrix material may act to keep the fibers in a desired location and orientation and also serve as a load-transfer medium between fibers within the composite.

The matrix material may comprise a resin component, which may be used to form a resin matrix. Suitable resin matrix materials that may be used in the composite materials described herein may include, but are not limited to, thermosetting resins including orthophthalic polyesters, isophthalic polyesters, phthalic/maelic type polyesters, vinyl esters, thermosetting epoxies, phenolics, cyanates, bismaleimides, nadic end-capped polyimides (e.g., PMR-15), and any combinations thereof. Additional resin matrix materials may include thermoplastic resins including polysulfones, polyamides, polycarbonates, polyphenylene oxides, polysulfides, polyether ether ketones, polyether sulfones, polyamide-imides, polyetherimides, polyimides, polyarylates, liquid crystalline polyester, polyurethanes, polyureas, and any combinations thereof.

In an embodiment, the matrix material may comprise a two-component resin composition. Suitable two-component resin materials may include a hardenable resin and a hardening agent that, when combined, react to form a cured resin matrix material. Suitable hardenable resins that may be used include, but are not limited to, organic resins such as bisphenol A diglycidyl ether resins, butoxymethyl butyl glycidyl ether resins, bisphenol A-epichlorohydrin resins, bisphenol F resins, polyepoxide resins, novolak resins, polyester resins, phenol-aldehyde resins, urea-aldehyde resins, furan resins, urethane resins, glycidyl ether resins, other epoxide resins, and any combinations thereof. Suitable hardening agents that can be used include, but are not limited to, cyclo-aliphatic amines; aromatic amines; aliphatic amines; imidazole; pyrazole; pyrazine; pyrimidine; pyridazine; 1H-indazole; purine; phthalazine; naphthyridine; quinoxaline; quinazoline; phenazine; imidazolidine; cinnoline; imidazoline; 1,3,5-triazine; thiazole; pteridine; indazole; amines; polyamines; amides; polyamides; 2-ethyl-4-methyl imidazole; and any combinations thereof. In an embodiment, one or more additional components may be added the matrix material to affect the properties of the matrix material. For example, one or more elastomeric components (e.g., nitrile rubber) may be added to increase the flexibility of the resulting matrix material.

The fibers may lend their characteristic properties, including their strength-related properties, to the composite. Fibers useful in the composite materials used to form a body portion and/or one or more bow springs may include, but are not limited to, glass fibers (e.g., e-glass, A-glass, E-CR-glass, C-glass, D-glass, R-glass, and/or S-glass), cellulosic fibers (e.g., viscose rayon, cotton, etc.), carbon fibers, graphite fibers, metal fibers (e.g., steel, aluminum, etc.), ceramic fibers, metallic-ceramic fibers, aramid fibers, and any combinations thereof.

The strength of the interface between the fibers and the matrix material may be modified or enhanced through the use of a surface coating agent. The surface coating agent may provide a physico-chemical link between the fiber and the resin matrix material, and thus may have an impact on the mechanical and chemical properties of the final composite. The surface coating agent may be applied to fibers during their manufacture or any other time prior to the formation of the composite material. Suitable surface coating agents may include, but are not limited to, surfactants, anti-static agents, lubricants, silazane, siloxanes, alkoxysilanes, aminosilanes, silanes, silanols, polyvinyl alcohol, and any combinations thereof.

The centralizer 200 also comprises one or more expandable elements 208 coupled to the first body portion 202 and the second body portion 204. The expandable elements 208 may serve to provide a tensile force between the first body portion 202 and the second body portion 204. In an embodiment, the expandable elements 208 may act as a spring between the first body element 202 and the second body element 204 so that the tensile force increases as the bows 206 are compressed and the distance between the body portions 202, 204 increases. Each expandable element may be configured to expand and contract in a longitudinal direction between the first body portion and the second body portion. The one or more expandable elements 208 may extend in a substantially straight line between the body portions 202, 204. During the expansion and/or contraction of the one or more expandable elements, the expandable elements may remain in a substantially straight line between the body portions 202, 204. The expandable elements may be disposed in contact with the wellbore tubular between the body portions and may contact the wellbore tubular. In an embodiment, the one or more expandable elements extend and are coupled to the body portions without contacting the outer wellbore wall and/or an outer wellbore tubular wall in either a compressed or uncompressed state of the centralizer.

In an embodiment, the one or more expandable elements may be configured to provide the tensile force between the body portions 202, 204 without a substantial movement and/ or expansion in a radial direction. The resulting tensile force may act to provide a restoring force to the centralizer and bow springs 206 in addition to the restoring force provided by the bow springs 206. In order to provide the restoring force to the centralizer, the tensile force may act on the first body portion 202 and the second body portion 204. The resulting tensile force may then be transferred from the body portions 202, 204 into the bow springs. Due to the curved configuration of the bow springs, the tensile force acting on the ends of the bow springs 206 may place the bow springs in compression. The bow springs may generally be formed from a material that is relatively non-compressible. The compressive force may then urge the ends towards each other and the central portion outwards towards a wall of the wellbore and/or outer wellbore tubular rather than substantially compressing the material forming the bow springs 206. Thus, the tensile force provided by the one or more expandable elements may be transferred through the body portions 202, 204 to the bow springs to provide a portion of the restoring force for the centralizer.

As illustrated in FIGS. 3A and 3B, the expandable elements 208 may generally extend longitudinally between the body portions 202, 204. In an embodiment, each expandable element 208 may comprise a strip of expandable material having a longitudinal length 302, thickness 304, and width 306 chosen to provide a desired tensile force between the body portions 202, 204. The one or more expandable elements may be coupled the first body portion 202 and the second body portion 204 using any means known in the art. For example, each expandable element 208 may be welded, brazed, diffusion bonded, connected using a connector, and/or integrally formed with the first body portion 202 and/or the second body portion 204. The one or more expandable elements 208 may be coupled to the body portions 202, 204 so that the one or more expandable elements 208 are disposed between adjacent bow springs 206. In other words, the one or more expandable elements may be radially offset about the central longitudinal axis from the bow springs so that the bow springs and/or the one or more expandable elements do not align or stack along an outer surface of the wellbore tubular 120. For example, for a centralizer comprising three bow springs and three expandable elements, the three bow springs may be aligned at radial positions corresponding to about 0 degrees, about 120 degrees, and about 240 degrees, and the three expandable elements may be aligned between the bow springs at radial positions corresponding to about 60 degrees, about 180 degrees, and about 300 degrees. The alignment of the expandable elements 208 between the bow springs 206 may avoid an overlap in the radial direction between the expandable elements 208 and the bow springs 206 when the bow springs 206 are compressed, thereby allowing the height of the centralizer to be reduced in a compressed state. In another embodiment, the one or more expandable elements 208 may align with the bow springs and/or partially overlap with one or more bow springs 206.

In an embodiment, a single expandable element 208 may be used with the centralizer 200. In other embodiments, two or more expandable elements 208 may be coupled to each of the body portions 202, 204. When two or more expandable elements 208 are present, the expandable elements 208 may be evenly spaced about the centralizer 200 (e.g., two expandable elements at 180 degrees apart, three expandable elements at 120 degrees apart, etc.) or the expandable elements may be positioned at non-even intervals about the centralizer. Additionally, when two or more expandable elements 208 are present, the expandable elements 208 may be evenly distributed between adjacent bow springs 206 or the expandable elements 208 may be positioned at non-even radial alignments between adjacent bow springs 206. The number of expandable elements 208 may be chosen based on the desired restoring force of the centralizer and the contribution to the desired restoring force from the plurality of bow springs 206 and the one or more expandable elements 208. The restoring force provided by the one or more expandable elements 208 may be tailored based on considerations including, but not limited to, the longitudinal length 302, the thickness 304, the width 306, and the composition of the expandable elements. The longitudinal length 302, thickness 304, and width 306 may be limited based upon the characteristics of the wellbore tubular and the wellbore into which the centralizer is disposed. For example, a wellbore comprising one or more close tolerances may limit the available thickness 304 of the expandable element. Further design factors that may affect the restoring force provided by an expandable element formed, for example, from a composite material may include, but are not limited to, a type of fiber or fibers used in forming the one or more expandable elements, and/or the type of matrix material or materials used to form the one or more expandable elements, each of which are discussed in more detail below. The design and number of expandable elements 208 may also be chosen to reduce the starting and/or drag forces while increasing the restoring force available within the wellbore.

The one or more expandable elements may be formed from one or more expandable or spring-like materials. For example, the one or more expandable elements may be formed from a material comprising a synthetic material (e.g., an elastomeric material such as a rubber, etc.), a metallic material, other suitable material, or any combination thereof, and appropriately configured to provide a spring force when stretched or expanded. In an embodiment, the one or more expandable elements may be formed from a composite material. When a plurality of expandable elements 208 are used, each of the expandable elements 208 may comprise the same materials or each of the expandable elements 208 may comprise different materials. As noted in more detail herein, composite materials may include a reinforcing agent and a matrix material.

The matrix material may comprise a resin component, which may be used to form a resin matrix. Suitable resin matrix materials that may be used in the composite materials forming the one or more expandable elements described herein may include, but are not limited to, thermosetting resins including orthophthalic polyesters, isophthalic polyesters, phthalic/maelic type polyesters, vinyl esters, thermosetting epoxies, phenolics, cyanates, bismaleimides, nadic end-capped polyimides (e.g., PMR-15), and any combinations thereof. Additional resin matrix materials may include thermoplastic resins including polysulfones, polyamides, polycarbonates, polyphenylene oxides, polysulfides, polyether ether ketones, polyether sulfones, polyamide-imides, polyetherimides, polyimides, polyarylates, liquid crystalline polyester, polyurethanes, polyureas, and any combinations thereof. In an embodiment, one or more additional components may be added the matrix material to affect the properties of the matrix material. For example, one or more elastomeric components (e.g., nitrile rubber) may be added to increase the flexibility of the resulting matrix material. When selecting a matrix material and suitable resin composition, consideration of the amount of expansion of the one or more expandable elements may be taken into account to provide a final, expandable product.

The fibers may lend their characteristic properties, including their strength-related properties, to the composite. Fibers useful in the composite materials used to form one or more expandable elements may include, but are not limited to, cellulosic fibers (e.g., viscose rayon, cotton, etc.), carbon fibers, aramid fibers, and any combinations thereof. As described in more detail herein, the alignment of the fibers within the composite material may affect the flexibility and amount of expansion achievable with the expandable elements.

The strength of the interface between the fibers and the matrix material may be modified or enhanced through the use of a surface coating agent as described above. Any of the surface coating agents described herein may be used with the composite materials forming the one or more expandable elements.

Figure 4A:
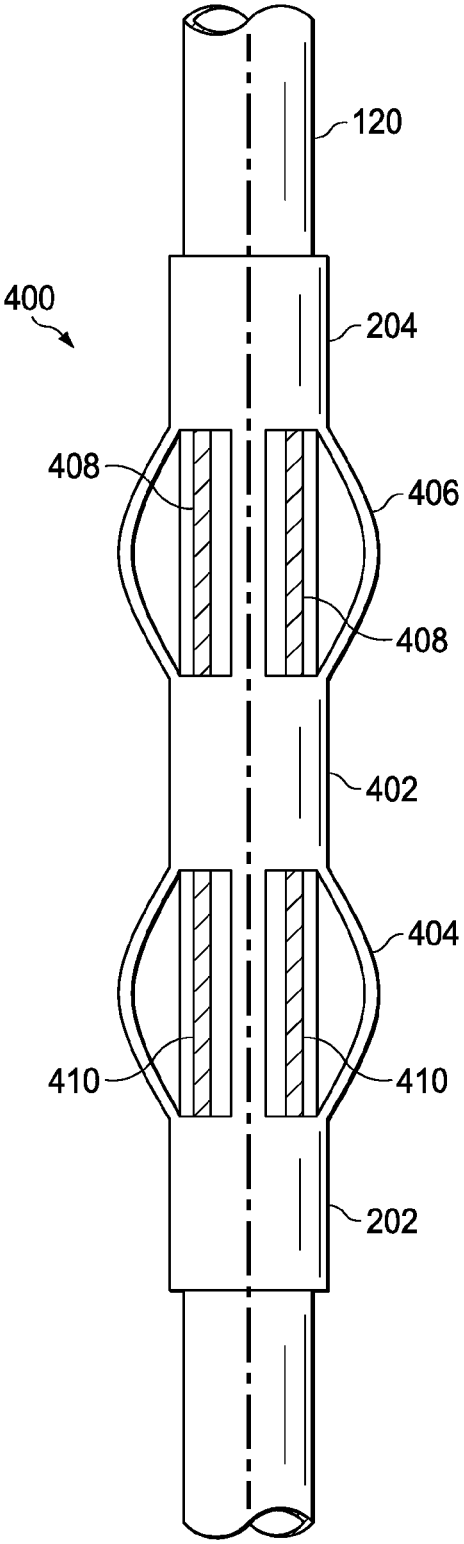
FIG. 4A is a plan view of a centralizer according to still another embodiment.

In an embodiment shown in FIG. 4A, a multi-section centralizer 400 design is shown with a third body portion 402 disposed between the first body portion 202 and the second body portion 204. A first section 404 of a plurality of bow springs may be used to couple the first body portion 202 and the third body portion 402, and a second section 406 of the plurality of bow springs may be used to couple the third body portion 402 and the second body portion 204. One or more of the expandable elements 410 may be coupled to the first body portion 202 and the third body portion 402, and one or more expandable elements 408 may be coupled to the third body portion 402 and the second body portion 204. In an embodiment, the multi-section centralizer 400 may only comprise the one or more expandable elements 408, 410 in one section (e.g., the one or more expandable elements 410 coupled to the first body portion 202 and the third body portion 402). The third body portion 402 may be similar in design to the body portions 202, 204. The body portions 202, 204, 402, the bow spring sections 404, 406, and the one or more expandable elements 408, 410 may comprise any of the designs discussed herein for the body portions, bow springs, and expandable elements, respectively. As shown in FIG. 4A, the number of bow springs in the first section 404 and the second section 406 of bow springs may be the same, and the bow springs in each section may be aligned along the longitudinal axis of the wellbore tubular. Similarly, the number of expandable elements 408, 410 may be the same, and the expandable elements in each section may be aligned along the longitudinal axis of the wellbore tubular. In an embodiment, the number of bow springs in the first section 404 and the second section 406 of bow springs may be different, and/or the number of expandable elements 408, 410 may be different.

Figure 4B:
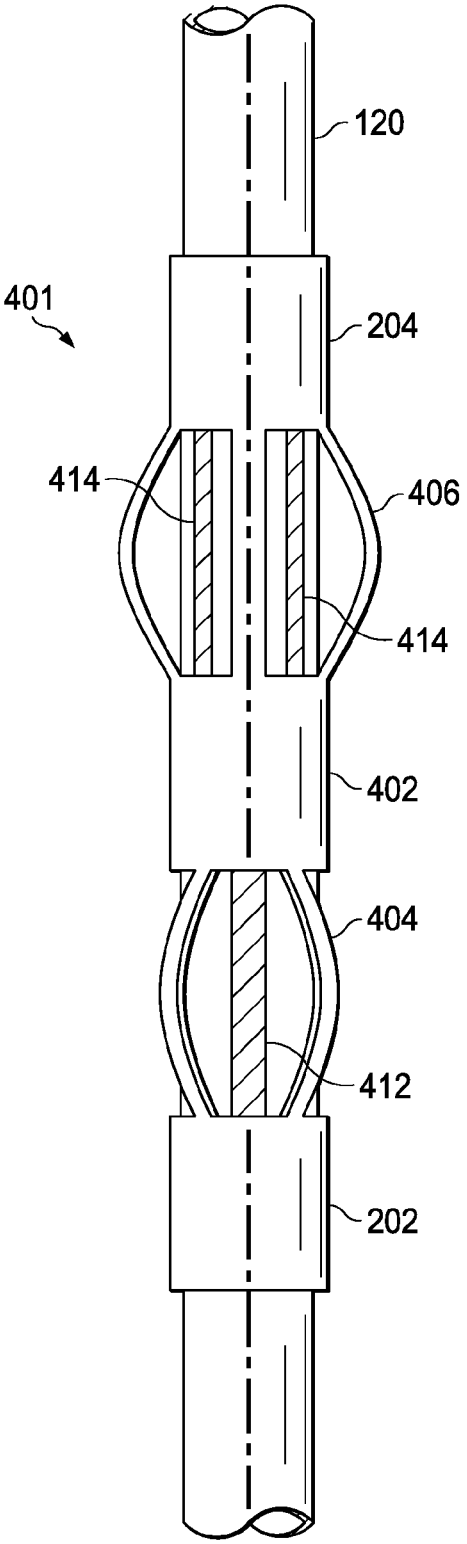
FIG. 4B is a plan view of a centralizer according to still another embodiment.

In another embodiment of a multi-section centralizer 401 as shown in FIG. 4B, the bow springs and/or the one or more expandable elements in each section may be radially offset about the central longitudinal axis so that the bow springs and/or the one or more expandable elements do not align along an outer surface of the wellbore tubular in a direction parallel to the longitudinal axis of the wellbore tubular 120. In other words, the bow springs and/or the one or more expandable elements may be in a first radial alignment (e.g., at radial positions originating from a central longitudinal axis in a plane normal to the longitudinal axis) in a first section, and in a second radial alignment in a second section. As a non-limiting example, a first section having three bow springs and three expandable elements with the bow springs aligned at radial positions corresponding to about 0 degrees, about 120 degrees, and about 240 degrees. The three expandable elements may be aligned between the bow springs at radial positions corresponding to about 60 degrees, about 180 degrees, and about 300 degrees. In a second section also comprising three bow springs and three expandable elements, the bow springs may be aligned at radial positions corresponding to about 60 degrees, about 180 degrees, and about 300 degrees, and the expandable elements in the second section may be aligned at radial positions corresponding to about 0 degrees, about 120 degrees, and about 240 degrees. In this embodiment, each bow spring in one section aligns with an expandable element in the other section, but the bow springs do not have the same radial positions in each section. In an embodiment, the bow springs and/or expandable elements in each section may not align. For example, the bow springs of the second section of the embodiment described above may be aligned at radial positions corresponding to about 30 degrees, about 150 degrees, and about 270 degrees, and the expandable elements in the second section may be aligned at radial positions corresponding to about 90 degrees, about 210 degrees, and about 330 degrees. While the bow springs and/or expandable elements have been described as being evenly distributed about the longitudinal axis, the bow springs and/or expandable elements may also be distributed unevenly about the longitudinal axis.

In another embodiment, the number of bow springs and/or the one or more expandable elements in the each section may be different, and/or the bow springs and/or the one or more expandable elements in each section may be offset so that the bow springs and/or the one or more expandable elements do not align. For example, the first section 404 may have 5 bow springs and 5 expandable elements, and the second section 406 may have 3 bow springs and one to four expandable elements. In this example, the bow springs and/or the one or more expandable elements in the first section and the second section may be arranged so that none of the bow springs 404 and/or the expandable elements 412 in the first section align along the longitudinal axis of the wellbore tubular 120 with any of the bow springs 406 and/or the expandable elements 414 in the second portion. As a non-limiting example, a first section having five bow springs and five expandable elements with the bow springs aligned at radial positions corresponding to about 0 degrees, about 72 degrees, about 144 degrees, about 216 degrees, and about 288 degrees. The five expandable elements may be aligned between the bow springs at radial positions corresponding to about 36 degrees, about 108 degrees, about 180 degrees, about 252 degrees, and about 324 degrees. In a second section comprising three bow springs and three expandable elements, the bow springs may be aligned at radial positions corresponding to about 60 degrees, about 180 degrees, and about 300 degrees, and the expandable elements in the second section may be aligned at radial positions corresponding to about 0 degrees, about 120 degrees, and about 240 degrees. In an embodiment, the use of multiple body portions to allow for additional bow springs and/or one or more expandable elements between the first body portion 202 and the second body portion 204 may increase the restoring force without a corresponding increase in the starting force, allowing for the desired properties to be tailored based on the design of the centralizer.

It will be appreciated that while a third body portion 402 is illustrated, any number of additional body portions may be disposed between subsequent portions of the bow springs and/or the one or more expandable elements to connect the first body portion 202 to the second body portion 204. In an embodiment, a plurality of body portions may be coupled by a plurality of portions of bow springs and/or one or more expandable elements. While a centralizer comprising a single section is described below for clarity, it is to be understood that the same concepts may be readily applied by one of ordinary skill in the art to a multi-section design.

A centralizer comprising a composite material used to form one or more body portions, bow springs, and/or expandable elements may be formed using any techniques known for forming a composite material into a desired shape. The fibers used in the process may be supplied in any of a number of available forms. For example, the fibers may be supplied as individual filaments wound on bobbins, yarns comprising a plurality of fibers wound together, tows, rovings, tapes, fabrics, other fiber broadgoods, or any combinations thereof. The fiber may pass through any number rollers, tensioners, or other standard elements to aid in guiding the fiber through the process to a resin bath.

In an embodiment, the formation process may begin with a fiber being delivered to a resin bath. The resin may comprise any resin or combination of resins known in the art, including those listed herein for the specific portions of the centralizer. The resin bath can be implemented in a variety of ways. For example, the resin bath may comprise a doctor blade roller bath wherein a polished rotating cylinder that is disposed in the bath picks up resin as it turns. The doctor bar presses against the cylinder to obtain a precise resin film thickness on cylinder and pushes excess resin back into the bath. As the fiber passes over the top of the cylinder and is in contact with the cylinder, the fiber may contact the resin film and wet out. In another embodiment, resin bath may comprise an immersion bath where the fiber is partially or wholly submerged into the resin and then pulled through a set of wipers or rollers that remove excess resin. In an embodiment, a portion of the fibers used to form the expandable elements may not be exposed to the resin bath. For example, a portion of the ends of the fibers may bypass the resin bath to produce a fiber that is coated in a central portion while one or more of the end portions remain uncoated. The uncoated portions may be used to form collar links as described in more detail herein.

After leaving the resin bath, the resin-wetted fiber may pass through various rings, eyelets, and/or combs to direct the resin-wetted fiber to a mandrel to form one or more bow springs and/or expandable elements. The fibers may be wound onto the mandrel to form the base for the one or more bow springs and/or expandable elements using an automated process that may allow for control of the direction of the winding and the winding pattern. The winding process may determine the thickness profile of the bow springs and/or an expandable elements in the formation process. Without intending to be limited by theory, it is expected that the winding pattern and orientation of the fibers may determine the degree of flexibility of the expandable elements, which may be used, at least in part, to design the amount of tensile force provided by the expandable elements during use. In an embodiment, particulates, which may comprise a surface coating agent, may be disposed on the outer surface of the bow springs after the fibers leave the resin bath and/or when disposed on the mandrel.

The wound fibers may be allowed to harden or set to a desired degree on the mandrel before being cut and removed from the mandrel as a mat. The mat may then be divided into strips of a desired dimension to initially form the one or more bow springs and/or expandable elements. For the bow springs, the strips may be placed in a shaped mold to cure in a desired shape. In an embodiment, the mold may comprise a two-piece block mold in which one or more of the strips are placed and formed into a desired shape due to the form of the two piece mold. The particulates, which may comprise a surface coating agent, may be disposed on the outer surface of the bow springs when the bow springs are placed in the mold. The mold may then be heated to heat cure the resin to a final, cured state. In another embodiment, other curing techniques may be used to cause the strips to harden to a final, cured state. After completing the curing process, the mold may be disassembled and the bow springs removed.

For the expandable elements, the strips of a divided mat may be placed in a mold or disposed in a curing device to cure the strips into expandable elements. For example, the strips used to form an expandable element may be placed in a heated chamber and allowed to cure at an appropriate temperature for the specific resin and/or elastomeric material selected. In another embodiment, other curing techniques may be used to cause the strips to cure to a final state. After completing the curing process for the expandable elements, the expandable elements may be removed from the chamber and/or curing device. In an embodiment, one or more of the expandable elements formed form a material other than a composite material (e.g., a metal, an elastomeric material, etc.) may be pre-formed using a suitable process and coupled to the remaining components of the centralizer (e.g., the body portions) as described herein.

One or more body portions may then be prepared according to a similar process. The fiber and/or combination of fibers used to form one or more body portions may be passed through a resin bath as described above. The resin-wetted fibers may then be wound onto a cylindrical mandrel of a desired shape, which may be the same or different than the cylindrical mandrel used to form the bow springs. In an embodiment, the cylindrical mandrel upon which the resin-wetted body portion fibers are wound may have a diameter approximately the same as the diameter of a wellbore tubular upon which the final centralizer is to be disposed. The fibers may be wound onto the cylindrical mandrel to form a portion of the body portion using an automated process that may allow for control of the direction of the winding and the winding pattern. After winding a portion of the resin-wetted body portion fibers onto the cylindrical mandrels, the bow springs and/or the one or more expandable elements may be placed onto the cylindrical mandrel in the desired positions. In an embodiment, a portion of the expandable elements may extend past the body portions for use as collar links. In an embodiment, one or more additional strips of material or fibers may be placed onto the cylindrical mandrel in the desired positions to form one or more collar links, which are discussed in more detail herein. The bow springs, the one or more expandable elements, and/or the optional collar links may be held in place using temporary restraining means (e.g., tape), or the resin used on the body portion fibers may be sufficiently tacky to hold the bow springs, expandable elements, and/or optional collar links in place during the remainder of the manufacturing process.

Additional resin-wetted body portion fibers may then be wound onto the cylindrical mandrel, at least a portion of which may be placed on top of the ends of the bow springs, the one or more expandable elements, and/or any optional collar links. In this manner, the bow springs and/or expandable elements may be integrally formed into the body portions. The fibers may be wound onto the cylindrical mandrel to form the remainder of the body portions using an automated process that may allow for control of the direction of the winding and the winding pattern. The formed centralizer may then be cured to produce a final, cured state in the body portions, the bow springs, and/or the expandable elements. In an embodiment, a heat cycle may be used to thermally cure a thermally curable resin, and/or any other number of curing processes may be used to cure an alternative or additional resin used in the formation of the composite centralizer. The cylindrical mandrel may then be pressed out of the centralizer. In an embodiment, the centralizer may then be disposed about a wellbore tubular and secured in place using any of the methods disclosed herein.

The winding process used to form the body portions, the bow springs, and/or the expandable elements may determine the direction of the fibers and the thickness of the body portions, the bow springs, and/or the expandable elements. The ability to control the direction and pattern of winding may allow for the properties of the completed centralizer and/or centralizer components to possess direction properties. In an embodiment, the direction of the fibers in the body portions may be different than the direction of the fibers in the bow springs, which may be the same or different than the direction of the fibers in the expandable elements. In an embodiment, the fibers in the body portions may generally be aligned in a circumferential direction, and the fibers in the bow springs may generally be aligned along the longitudinal axis of the centralizer. The fibers in the expandable elements may be aligned at any angle between the circumferential direction and the longitudinal direction, and the direction of the fibers may affect the amount of spring force produced by a given longitudinal expansion.

In an embodiment, the centralizer formation process may be designed by and/or controlled by an automated process, which may be implemented as software operating on a processor. The automated process may consider various desired properties of the centralizer as inputs and calculate a design of the centralizer based on the properties of the available materials and the available manufacturing processes. In an embodiment, the automated process may consider various properties of the materials available for use in the construction of the centralizer including, but not limited to, the diameter, stiffness, moduli, and cost of the fibers. The desired properties of the centralizer may comprise the geometry of the centralizer, the restoring force, the running force, the starting force, the amount of restoring force provided by the bow springs relative to the expandable elements, and any other specific considerations such as a desired choice of materials. The use of the automated process may allow for centralizers to be designed for specific uses and allow the most cost effective design to be chosen at the time of manufacture. Thus, the ability to tailor the design of the centralizer to provide a desired set of properties may offer an advantage of the centralizer and methods disclosed herein.

While discussed in terms of an entirely composite centralizer, the formation process described herein may also apply if one or more of the components were formed from a material other than a composite material. For example, if the bow springs and/or the one or more expandable elements comprised only a metallic material, the bow springs and/or the one or more expandable elements can be integrally formed with a composite body portion during the formation process. Similarly, if the expandable elements comprised an elastomeric material without any fibers, the expandable elements can be formed and integrated into the remainder of the centralizer using the process described herein. In addition to the process described herein, other suitable formation processes for the centralizer may be used.

The centralizer 200 may be disposed about a wellbore tubular 120 and maintained in place using any technique known in the art. In an embodiment as shown in FIGS. 3A and 3B, stop collars 308 may be used to retain the centralizer 200 on a wellbore tubular 120. The stop collars 308 may be made from steel or similar high strength material. In an embodiment, the stop collars 308 may be constructed from a composite material. The stop collars 308 may be generally cylindrically shaped and may have an internal diameter selected to fit about the exterior of the wellbore tubular 120 to which they are to be affixed. The stop collars 308 may be affixed to the exterior of the wellbore tubular using set screws or any other device known in the art for such purpose. In an embodiment, the stop collars may be constructed of a composite material and may take the form of any of the stop collars shown in U.S. Patent Application Publication Nos. US 2005/0224123 A1, entitled "Integral Centraliser" and published on Oct. 13, 2005, and US 2007/0131414 A1, entitled "Method for Making Centralizers for Centralising a Tight Fitting Casing in a Borehole" and published on Jun. 14, 2007, both of which are incorporated herein by reference in their entirety. The use of stop collars 308 may allow the centralizer 200 to rotate with respect to the wellbore tubular 120 as the centralizer 200 may not be fixedly coupled to the wellbore tubular 120.

Additional connection methods may be used to couple the centralizer to the wellbore tubular. In an embodiment, a projection may be formed on the wellbore tubular using a composite material that is capable of retaining the centralizer 200 on the wellbore tubular 120. Suitable projections and methods of making the same are disclosed in U.S. Patent Application Publication No. 2005/0224123 A1 to Baynham et al. and published on Oct. 13, 2005, the entire disclose of which is incorporated herein by reference. The projections may comprise a composite material, which may comprise a ceramic based resin including, but not limited to, the types disclosed in U.S. Patent Application Publication Nos. US 2005/0224123 A1, entitled "Integral Centraliser" and published on Oct. 13, 2005, and US 2007/0131414 A1, entitled "Method for Making Centralizers for Centralising a Tight Fitting Casing in a Borehole" and published on Jun. 14, 2007, both of which were incorporated by reference above.

In another embodiment as shown in the centralizer 200 of FIG. 2, at least one window 250 may be disposed in the first body portion 202 and/or the second body portion 204, and may be used to couple the centralizer 200 to a wellbore tubular 120. The window disposed in one or more of the body portions 202, 204 may comprise a cutout of the body portion 202, 204 that allows for access through the body portion 202, 204. An upset 252 may be created within the window 250 to couple the centralizer 200 to the wellbore tubular 120. Suitable configurations, materials, and methods of coupling the centralizer 200 to the wellbore tubular 120 using a window with an upset disposed therein are disclosed in co-pending U.S. patent application Ser. No. 12/964,605, now U.S. Pat. No. 8,505,624, filed on Dec. 9, 2010, and entitled "Integral Pull-Through Centralizer," the entire disclosure of which is incorporated herein by reference.

Figure 5A:
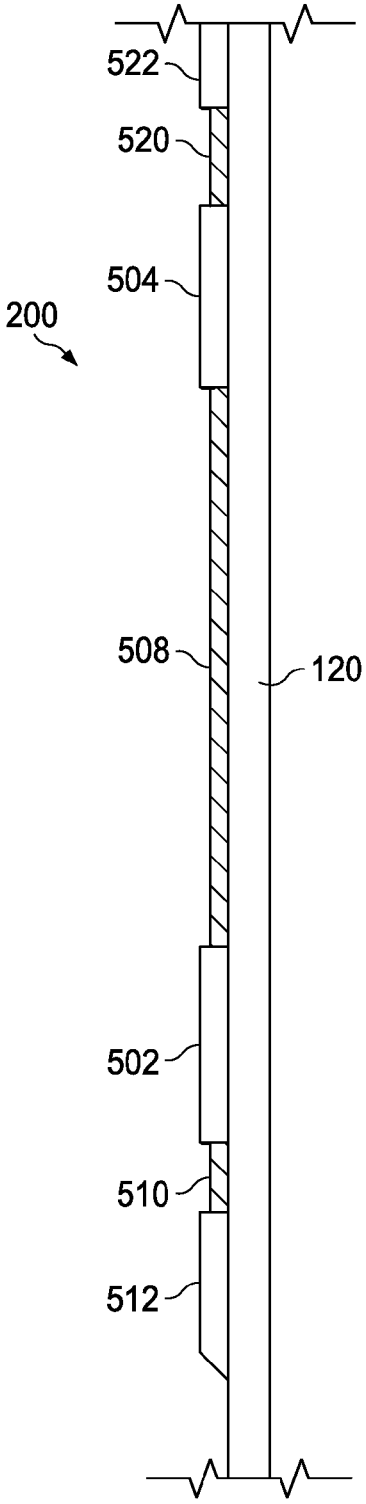
FIG. 5A is a cross sectional view of a centralizer according to yet another embodiment.
Figure 5B:
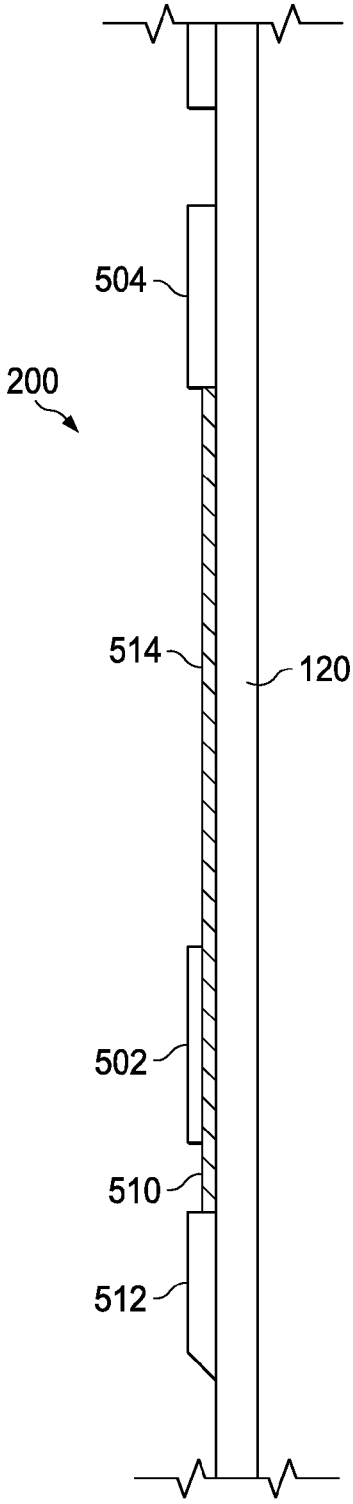
FIG. 5B is a cross sectional view of a centralizer according to yet another embodiment.

In an embodiment as shown in FIGS. 5A and 5B, the first body portion 502 and/or the second body portion 504 may be coupled to a stop collar 512, 522 or other retaining feature by one or more collar links 510, 520. The use of the one or more collar links 510, 520 may allow the centralizer 200 to be pulled into the wellbore. For example, if the wellbore tubular 120 were moving to the left in FIG. 5A, the centralizer may be pulled to the left due to the coupling of the collar link 510 to the first body portion 502 and the stop collar 512, which is fixedly coupled to the wellbore tubular 120. Similarly, the centralizer 200 may be pulled out of the wellbore as the wellbore tubular 120 is conveyed out of the wellbore due the coupling of the collar link 520 to the second body portion 504 and to the stop collar 522, which is fixedly coupled to the wellbore tubular 120. By pulling the centralizer 200 into the wellbore, rather than pushing the centralizer 200 into the wellbore, the starting force required to insert the centralizer 200 into a restriction (e.g., a close tolerance restriction) may be reduced. Pulling may reduce the starting force by allowing the bow springs to be radially compressed without also being longitudinally compressed, as would occur if the centralizer where pushed into a restriction. Pulling the centralizer 200 during conveyance within the wellbore may also be advantageous in preventing potential damage and/or collapse of the centralizer 200 within the wellbore upon contacting an obstruction or close tolerance restriction.

As shown in FIG. 5A, one or more collar links 510, 520 may be used to couple the centralizer to one or more of the stop collars 512, 522. The collar links 510, 520 may comprise any suitable material for coupling the first body portion 502 to the stop collar 512, and/or the second body portion 504 to the stop collar 522. In an embodiment, the collar links 510, 520 may comprise a portion of an expandable element 508 of the type described herein. For example, the collar links 510, 520 may comprise a short section of an expandable element material that is coupled to the first body portion 502 and the stop collar 512, and/or the second body portion 504 and the stop collar 522. The one or more collar links 510 may be coupled the body portions 502, 504 and/or the stop collars 512, 522 using any means known in the art. For example, each collar link 510 may be welded, brazed, diffusion bonded, connected using a connector, and/or integrally formed with the body portions 502, 504 and/or the stop collars 512, 522. In an embodiment in which the stop collar comprises a composite material such as any of the stop collars shown in U.S. Patent Application Publication Nos. US 2005/0224123 A1, entitled "Integral Centraliser" and published on Oct. 13, 2005, and US 2007/0131414 A1, entitled "Method for Making Centralizers for Centralising a Tight Fitting Casing in a Borehole" and published on Jun. 14, 2007, the collar links 510, 520 may be integrally formed with the composite material during its disposition on the wellbore tubular 120. In an embodiment, only one of the body portions 502, 504 is coupled to the adjacent stop collar 512, 522.

In an embodiment as shown in FIG. 5B, the collar link 510 may comprise an extension of the expandable element 514 or an extension of some portion of the expandable element 514. In this embodiment, the expandable element 514 may be coupled to the first body portion 502. A collar link portion 510 of the expandable element 514 may then extend through and beyond the first body portion 502 and be coupled to the stop collar 512. In an embodiment, only a portion of the expandable element 514 may extend through and/or beyond the first body portion 502. For example, when the expandable element comprises a composite material, the entire composite material may be coupled to the first body portion 502 while only the matrix material or the fibers may extend through and/or beyond the first body portion 502 and be coupled to the stop collar 512. In an embodiment in which the fibers form the collar link 510, the fibers of the expandable element 514 may be integrally formed with the first body portion 502 and/or the stop collar 512. The use of only a portion of the expandable element 514 may allow for a sufficient force to be applied to the centralizer 200 to pull the centralizer 200 into and/or out of the wellbore while reducing the amount of additional material needed to couple the centralizer to one or more of the stop collars.

Referring to FIGS. 5A and 5B, the one or more collar links 510, 520 may comprise a shear mechanism to allow the body portion 502, 504 to be de-coupled from the stop collar 512, 522 upon the application of a sufficient force. When one or more collar links 510, 520 are used to couple the centralizer to one or more stop collars 512, 522, the centralizer 200 may be capable of rotating about the wellbore tubular 120 to a limited degree as allowed by the length of the one or more collar links 510, 520. A rotation of the wellbore tubular about the longitudinal direction of the wellbore may then produce a rotational force on the centralizer as transferred through the one or more collar links 510, 520. The one or more collar links 510, 520 may have the same or different threshold for failing in a longitudinal direction (i.e., a tensile force applied in a longitudinal direction) and a rotational direction (i.e., a shear force applied in a rotational direction about the longitudinal axis of the wellbore). In an embodiment, the one or more collar links 510, 520 may be configured to withstand a longitudinal force expected to be encountered within the wellbore such as, for example, the running forces and/or the starting forces for a specific wellbore and/or restriction (e.g., a close tolerance restriction). In an embodiment, the one or more collar links may be configured to shear at a threshold force applied in a rotational direction. This configuration may allow the centralizer 200 to be pulled into the wellbore until the centralizer is disposed at a desired position, and the one or more collar links may then be sheared through the application of a rotational motion to provide a shear force above a threshold to the one or more collar links.

In an embodiment, the shear mechanism may be configured to allow the one or more collar links to de-couple above a threshold force. The shear mechanism may comprise a reduced strength portion of the collar link, such as a perforation line or lines in the collar links. Alternatively or in addition to the perforation lines, the shear mechanism may comprise a reduced strength portion of the collar links comprising a specific fiber alignment. For example, one or more fibers forming the one or more collar links may be aligned in the longitudinal direction, or at a suitable angle to the longitudinal direction, to thereby provide a difference between the amount of longitudinal force and rotational force that can be supported by the one or more collar links. In an embodiment, the fibers may be capable of supporting a greater longitudinal force than a rotation force. In an embodiment, the one or more stop collars 512, 522 and/or the body portions 502, 504 may comprise an edge or shearing surface to engage the collar link 510, 520 upon a specific motion and/or displacement (e.g., a sufficient rotational displacement) and shear the collar link 510, 520.

Figure 6:
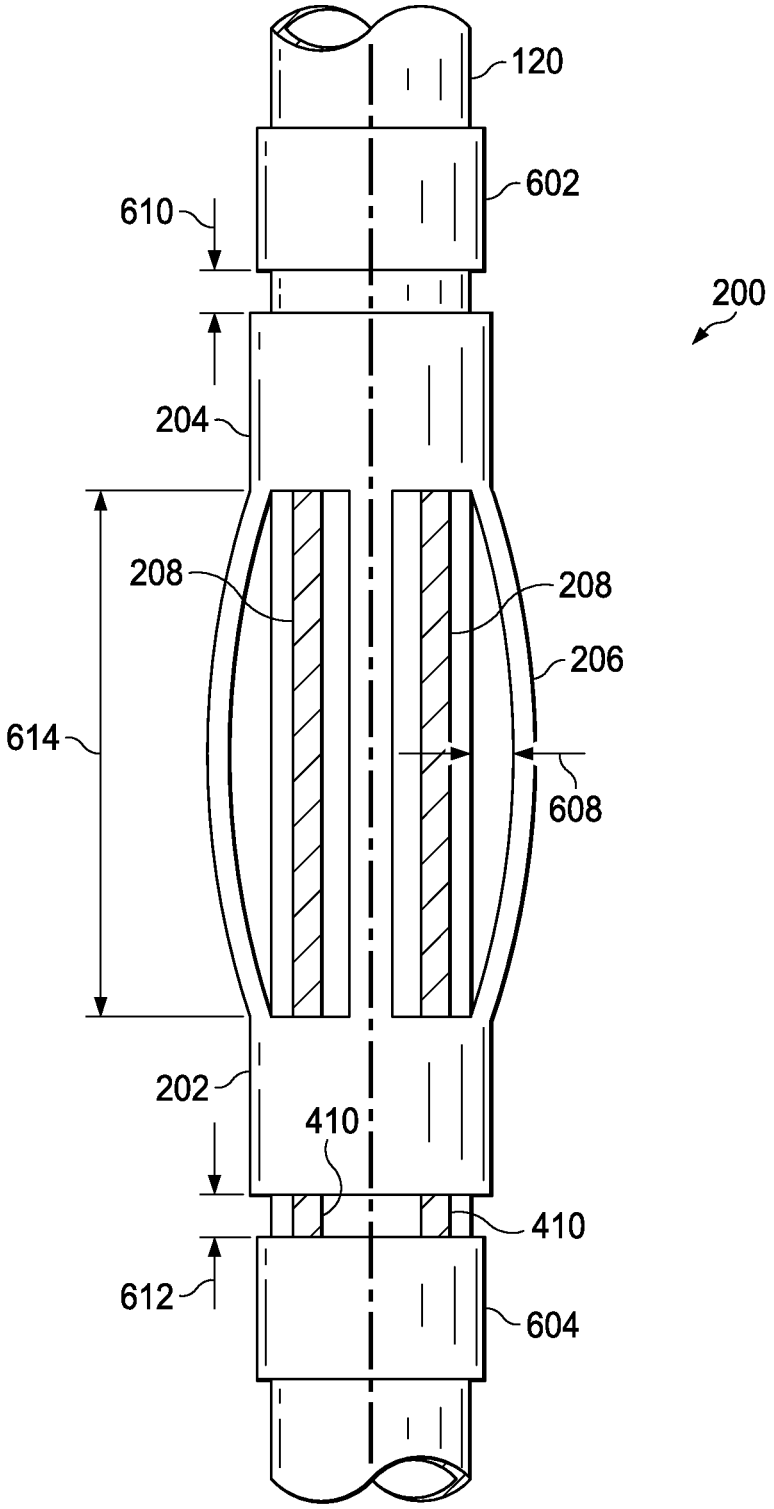
FIG. 6 is a plan view of a centralizer according to another embodiment.

Referring to FIG. 6, the one or more expandable elements may provide a tensile force between the first body portion 202 and the second body portion 204. The tensile force acting between the body portions 202, 204 may be transferred to the bow springs 206, which may act to increase the restoring force of the plurality of bow springs 206 and thus the overall restoring force of the centralizer. The amount of restoring force provided by the plurality of bow springs 206 relative to the one or more expandable elements 208 may be based on the properties of the bow springs 206, the properties of the one or more expandable elements 208, and the geometry of the centralizer 200. As illustrated in FIG. 6, one or more stop collars 602, 604 or other means of retaining the centralizer 200 on the wellbore tubular 120 may be sufficiently spaced apart to allow the centralizer 200 to expand longitudinally when the bow springs 206 are radially compressed. The radial, inward compression of the bow springs 206 creates a longitudinal lengthening of the distance 614 between the body portions 202, 204, thus increasing the overall length of the centralizer 200. The increase in length of the centralizer 200 is approximately the same as or greater than the radial distance 608 traveled by bow spring 206 during the compression. In order to accommodate this longitudinal travel, the stop collars 602, 604 may be spaced so that the sum of the distances 610 and 612 are equal to or greater than the greatest radial travel distance 608 of the plurality of bow springs 206. In an embodiment, the sum of the distances 610 and 612 may be about 5% to about 20% greater than the distance 608 to allow for operational tolerances and the optional use of one or more collar links 410 during coupling of the centralizer 200 to the wellbore tubular 120 using the stop collars 602, 604.

The longitudinal lengthening of the distance 614 between the body portions 202, 204 represents the distance by which the expandable elements 208 are longitudinally lengthened. The restoring force profile of the centralizer may be designed based on the design of the plurality of bow springs 206, the design of the one or more expandable elements 208, the initial force on the expandable elements 208, and the ratio of the restoring force provided by the bow springs 206 to the restoring force provided by the expandable elements 208. The design of the plurality of bow springs 206 and the design of the one or more expandable elements 208 are described in more detail herein and any of the considerations described herein may be used in the design of the restoring force profile of the centralizer. The initial force on the expandable elements 208 may be determined by the initial positioning of the expandable elements relative to the first body portion 202 and the second body portion 204. The expandable elements may be coupled to the first body portion 202 and the second body portion 204 in a pre-stressed position or a resting position. In a pre-stressed position, the one or more expandable elements 208 may be in tension in a resting, non-compressed state of the centralizer 200. Alternatively, the one or more expandable elements 208 may not experience a force in a non-compressed state of the centralizer, and a tensile force may only be developed upon a lengthening of the expandable elements 208 by a certain amount. In an embodiment, the expandable elements may act as springs as the bow springs 206 compress and the expandable elements 208 are stretched or lengthened. In general, it is expected that the expandable elements may provide a greater restoring force the further the distance between the body portions 202, 204 is increased. The ratio of the portion of the restoring force of the centralizer provided by the bow springs 206 to the portion of the restoring force provided by the expandable elements 208 can be adjusted based on the design and number of the bow springs 206 and the design and number of the expandable elements 208. In an embodiment, the ratio of the portion of the restoring force provided by the bow springs 206 to the portion of the restoring force provided by the expandable elements 208 may be between about 1:10 and about 10:1, or about 1:5 and about 5:1. In an embodiment, the one or more expandable elements may provide greater than about 10%, greater than about 20%, greater than about 30%, greater than about 40%, greater than about 50%, or greater than about 60% of the total restoring force of the centralizer 200.

As illustrated in FIG. 6, the one or more expandable elements 208 may extend longitudinally between the first body portion 202 and the second body portion 204. As also shown, the bow springs 206 are generally disposed in a bow shape between the body portions 202, 204 and have a standoff of the radial distance 608. In an embodiment, the one or more expandable elements 208 may be substantially parallel to the wellbore tubular 120 and lie against the wellbore tubular 120. The distance between a surface of the one or more expandable elements and a surface of the wellbore tubular may be less than about 10%, less than about 5%, less than about 3%, less than about 2%, or less than about 1% of the radial standoff 608 of the bow springs in an uncompressed state. Further, the one or more expandable elements 208 may not contact the wellbore wall and/or a wall of an outer wellbore tubular even when the bow springs 206 are in a compressed state. Thus, the one or more expandable elements may be distinguished from the bow springs 206 in at least one way including: the one or more expandable elements 208 may extend substantially straight between the body portions 202, 204 rather than being configured to extend radially like the bow springs, the one or more expandable elements 208 may expand or contract only in a direction substantially aligned with the longitudinal axis of the centralizer and/or wellbore rather than moving in a radial direction like the bow springs, the one or more expandable elements 208 may be capable of stretching to provide a spring force between the body portions, the one or more expandable elements 208 may remain in contact with a wellbore tubular disposed within the centralizer during a transition from a compressed to an uncompressed state and/or from an uncompressed to a compressed state rather than expanding in a radial direction during a transition between states, the one or more expandable elements 208 may remain within about 10% of the radial standoff 608 distance from the wellbore tubular surface rather than expanding the full radial offset 608 during transition between states, and/or the one or more expandable elements provide a tensile force between the body portions 202, 204 based on a tensile force in the longitudinal direction of the expandable element rather than providing a force to the centralizer based on a bending force of the bow springs.

Returning to FIG. 2, the thickness or height 152 of the first body portion 202, the second body portion 204, the bow springs 206, the expandable elements 208, and/or the upset 304 (or alternatively a stop collar) may vary depending on the width of the annulus available between the wellbore tubular 120 and the side of the wellbore or the inner surface 166 of the casing, depending on whether or not the wellbore has been cased. Due to the tolerances available within a wellbore, a well operator may specify a minimum tolerance for the space between the outermost surface 168 of a wellbore tubular 120, including the centralizer 200, and the inner surface 166 of the wellbore or the casing disposed within the wellbore. Using the tolerance, the height of the first body portion 202, the second body portion 204, the bow springs 206, the expandable elements 208, and/or the upset may be less than the annular diameter difference minus the tolerance set by the well operator. In an embodiment, the tolerance may be about 0.1 inches to about 0.2 inches. In an embodiment, no tolerance may be allowed other than the pipe manufacturer's tolerances, which may be based on industry standards (e.g., American Petroleum Institute (API) standards applicable to the production of a wellbore tubular), of about 1% based on the outer diameter of the wellbore tubular 120 and the drift tolerance of the inner diameter of the close tolerance restriction present in the wellbore (e.g., a casing through which the wellbore tubular comprising the centralizer passes). The minimum height of the first body portion 202, the second body portion 204, the bow springs 206, the expandable elements 208, and/or the upset 304 may be determined based on the structural and mechanical properties of the first body portion 202, the second body portion 204, the bow springs 206, the expandable elements 208, and/or the upset 304. The height of each of the first body portion 202, the second body portion 204, the bow springs 206, the expandable elements 208, and the upset 304 may the same or different. The use of both the bow springs 206 and the expandable elements 208 may allow the centralizer to be less than the annular diameter difference by the tolerance amount while still maintaining a desired restoring force for centralizing the wellbore tubular 120.

In use, the centralizer may be used to centralize a wellbore tubular within a wellbore. As noted herein, a wellbore tubular may be provided with a centralizer coupled thereto. The centralizer may comprise a first body portion, a second body portion, a plurality of bow springs connecting the first body portion to the second body portion, and one or more expandable elements coupled to the first body portion and the second body portion. As the wellbore tubular is conveyed within the wellbore, the restoring force provided by the plurality of bow springs may serve to space the wellbore tubular from the wellbore walls. In general, the centralizing effect may occur when a bow spring is radially compressed inward from a starting position to a compressed position. The one or more expandable elements may then apply a tensile force between the first body portion and the second body portion while the bow spring is in the compressed position. As a result of both the restoring force of the plurality of bow springs and the restoring force resulting from the tensile force applied between the first body portion and the second body portion, the bow spring can be restored from the compressed position to the starting position. For example, when the wellbore tubular enters a portion of the wellbore having an increased diameter, the bow springs may move radially outward and may engage the wellbore wall and/or the wall of an outer wellbore tubular. Thus, the one or more expandable elements can be used to provide a restoring force for a centralizer disposed on a wellbore tubular within a wellbore through the application of a tensile force in the longitudinal direction between the first body portion and the second body portion. In an embodiment, the one or more expandable elements may remain about flush and/or in contact with the wellbore tubular during the transition of the bow springs from a compressed to an uncompressed state and/or an uncompressed to a compressed state.

A method of centralizing a wellbore tubular in a wellbore comprising a restriction (e.g., a close tolerance restriction) comprises engaging a centralizer disposed on a wellbore tubular with the restriction in the wellbore. The bow springs can then be radially compressed, which results in the lengthening of the one or more expandable elements. The centralizer can then be disengaged from the restriction (e.g., when the centralizer on the wellbore tubular moves from a narrower wellbore diameter to a larger wellbore diameter) and the bow springs can be radially expanded. At least a portion of the force to radially expand the bow springs can be provided by the expandable elements. For example, the tensile force provided by the expandable elements in a longitudinal direction may be converted to a restoring force in the bow springs.

In an embodiment, a plurality of centralizers may be used with one or more wellbore tubular sections. A wellbore tubular string refers to a plurality of wellbore tubular sections connected together for conveyance within the wellbore. For example, the wellbore tubular string may comprise a casing string conveyed within the wellbore for cementing. The wellbore casing string may pass through the wellbore prior to the first casing string being cemented, or the casing string may pass through one or more casing strings that have been cemented in place within the wellbore. In an embodiment, the wellbore tubular string may comprise premium connections, flush connections, and/or nearly flush connections. One or more close tolerance restrictions may be encountered as the wellbore tubular string passes through the wellbore or the casing strings cemented in place within the wellbore (e.g., for example through lengths of concentric casing strings of progressively narrower diameter and/or into an under reamed section). A plurality of centralizers as described herein may be used on the wellbore tubular string to centralize the wellbore tubular string as it is conveyed within the wellbore. The number of centralizers and their respective spacing along a wellbore tubular string may be determined based on a number of considerations including the properties of each centralizer (e.g., the restoring force, the starting force, the drag force, etc.), the properties of the wellbore tubular (e.g., the sizing, the weight, etc.), and the properties of the wellbore through which the wellbore tubular is passing (e.g., the annular diameter difference, the tortuosity, the orientation of the wellbore, etc.). In an embodiment, a wellbore design program may be used to determine the number and type of the centralizers based on the various inputs as described herein. The number of centralizers and the spacing of the centralizers along the wellbore tubular may vary along the length of the wellbore tubular based on the expected conditions within the wellbore.

In an embodiment, a plurality of centralizers comprising a first body portion, a second body portion, a plurality of bow springs connecting the first body portion to the second body portion, and one or more expandable elements coupled with the first body portion and the second body portion may be placed on a wellbore tubular string. One or more limit components (e.g., stop collars and/or upsets) may be disposed on the wellbore tubular to retain the centralizer on the wellbore tubular. The wellbore tubular string may then be placed in the wellbore disposed in a subterranean formation. In an embodiment, the wellbore may comprise at least one close tolerance restriction within the wellbore.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A centralizer system comprising:

a first body portion;

a second body portion;

a plurality of bow springs connecting the first body portion to the second body portion;

one or more expandable elements coupled to the first body portion and the second body portion;

a wellbore tubular disposed longitudinally within the first body portion, the second body portion, the plurality of bow springs, and the one or more expandable elements;

a stop collar coupled to the wellbore tubular and configured to limit the longitudinal movement of the centralizer with respect to the wellbore tubular; and a collar link coupled to the first body portion and the stop collar.

2. The centralizer system of claim 1, wherein the one or more expandable elements extend substantially straight between the first body portion and the second body portion.

3. The centralizer system of claim 1, wherein the one or more expandable elements comprise a composite material, and wherein the composite material comprises a fiber and a matrix material.

4. The centralizer system of claim 3, wherein the fiber comprises a cellulosic fiber, a carbon fiber, an aramid fiber, and any combination thereof.

5. The centralizer system of claim 3, wherein the matrix material comprises a resin comprising at least one component selected from the group consisting of: an orthophthalic polyester, an isophthalic polyester, a phthalic/maelic type polyester, a vinyl ester, a thermosetting epoxy, a phenolic, a cyanate, a bismaleimide, a nadic end-capped polyimide, a polysulfone, a polyamide, a polycarbonate, a polyphenylene oxide, a polysulfide, a polyether ether ketone, a polyether sulfone, a polyamide-imide, a polyetherimide, a polyimide, a polyarylate, a liquid crystalline polyester, a polyurethane, a polyurea, and any combination thereof.

6. The centralizer system of claim 5, wherein the matrix material further comprises one or more elastomeric components.

7. The centralizer system of claim 1, wherein the one or more expandable elements are disposed between adjacent bow springs of the plurality of bow springs.

8. The centralizer system of claim 1, wherein the one or more expandable elements are configured to provide a tensile force between the first body portion and the second body portion.

9. The centralizer system of claim 1, wherein the plurality of bow springs are configured to provide a first portion of a restoring force for the centralizer and the one or more expandable elements are configured to provide a second portion of the restoring force for the centralizer.

10. The centralizer system of claim 9, wherein the ratio of the first portion of the restoring force to the second portion of the restoring force is between about 1:10 and about 10:1.

11. The centralizer system of claim 9, wherein the second portion of the restoring force is greater than about 10% of the restoring force for the centralizer.

12. The centralizer system of claim 1, wherein the collar link comprises an extension of at least a portion of the one or more expandable elements.

13. The centralizer system of claim 1, wherein the one or more expandable elements comprise a composite material, wherein the composite material comprises a fiber and a matrix material, and wherein the collar link comprises the fiber of the one or more expandable elements that extends through the first body portion.

14. The centralizer system of claim 1, wherein the collar link is configured to shear at a predetermined threshold.

15. The centralizer system of claim 1, further comprising a third body portion, wherein the third body portion is coupled to a first portion of the plurality of bow springs and a second portion of the plurality of bow springs.

16. A method of centralizing a wellbore tubular comprising:

compressing a bow spring radially inward from a starting position to a compressed position, wherein the bow spring is coupled to a first body portion and a second body portion;

applying a tensile force between the first body portion and the second body portion using one or more expandable elements coupled between the first body portion and the second body portion while the bow spring is in the compressed position, wherein the one or more expandable elements provide the tensile force between the first body portion and the second body portion without a substantial movement or expansion in a radial direction; and restoring the bow spring from the compressed position to the starting position.

17. The method of claim 16, wherein restoring the bow spring from the compressed position to the starting position is based on a total restoring force, and wherein the one or more expandable elements provide a portion of the restoring force.

18. The method of claim 17, wherein the portion of the restoring force provided by the one or more expandable elements is greater than about 10% of the total restoring force.

* * * * *